United States Patent [19]

Danti

[11] 4,304,332

[45] Dec. 8, 1981

[54] PACKAGE

[76] Inventor: Bernard R. Danti, 6 Alfred Cir., Bedford, Mass. 01730

[21] Appl. No.: 88,609

[22] Filed: Oct. 26, 1979

[51] Int. Cl.[3] ..... B65D 65/00; B65D 75/00

[52] U.S. Cl. ..... 206/432; 206/427; 206/497; 206/597

[58] Field of Search ..... 206/432, 497, 597, 427

[56] References Cited

U.S. PATENT DOCUMENTS

| | | | |
|---|---|---|---|
| 3,246,744 | 4/1966 | Marnon | 206/597 |
| 3,331,105 | 7/1967 | Gordon | 206/497 |
| 3,557,516 | 1/1971 | Brandt | 206/432 |
| 3,788,462 | 1/1974 | Meincer | 206/497 |
| 3,834,525 | 9/1974 | Morgese et al. | 206/432 |
| 3,986,611 | 10/1976 | Dreher | 206/497 |
| 4,062,448 | 12/1977 | Meighan | 206/432 |
| 4,077,516 | 3/1978 | Duerr | 206/432 |

*Primary Examiner*—Joseph Man-fu Moy

*Attorney, Agent, or Firm*—Robert A. Cesari; John F. McKenna; Andrew F. Kehoe

[57] ABSTRACT

A novel package means especially useful in packaging a plurality of canned goods, e.g. soft drinks and the like. The package comprises two tensioned film wraps, arranged at right angles to one another about the package item, and wherein one wrap serves as a handle means.

13 Claims, 5 Drawing Figures

PACKAGE

BACKGROUND OF THE INVENTION

This invention relates to a novel packaging process and packages formed thereby. The invention is particularly valuable in packaging canned goods and the like.

There are very substantial costs incurred in packaging, for shipment, of sucb products as soft drinks, canned vegetables and the like. Even the most inexpensive packages cost several cents per package. Moreover, the most inexpensive packages are, at best, incomplete packages having the characteristics of a tray rather than a complete package. The corrugated trays in which one buys a case of twenty-four cans of beer are typical of such trays. They provide no protection for the top of the can despite the fact that they use the scored aluminum openings on such cans invariably results in the liquid contacting the top of the can when the drink is imbibed directly from the can. Also, the tray is awkward to carry. This awkwardness is a common feature of much of packaging known to the art.

It has been known to shrink a heat-shrinkable plastic film shield about the top of cans packaged in these trays, but this adds up to 35 or 40% to the already-expensive package. The shield does nothing to solve the awkward shape of a package which would contain, e.g., 24 cans. Thus, the packaging of canned or bottled goods has remained an expensive procedure which has not yet yielded wholly satisfactory results.

Applicant has directed himself to providing a superior package and lower cost.

SUMMARY OF THE INVENTION

Therefore, it is a principal object of the present invention to prepare a superior package for a plurality of canned goods and to achieve the superior package in an economical manner.

Another object of the invention is to provide a new package which achieves a number of important features, e.g. economy and facile handling characteristics, and achieves such features at a remarkably low cost.

Still another object of the invention is to provide a novel package of excellent aesthetic character, making it possible to display substantially all the art work on a plurality of packaged articles.

A further object of the invention is to provide a novel package in which the packaged goods may be substantially cooled with ice without being removed from the package.

Other objects of the invention are to provide the packaging procedures by which the aforesaid objectives are achieved.

Still other objects will be obvious to those skilled in the art on their reading of this disclosure.

The above objects have been substantially achieved by the packaging of a plurality of articles within two tensioned polymer film wraps, each wrap arranged at right angles to the other. In a preferred embodiment, the package is shorter in one dimension and the upper segment of the tensioned wrap serves as an excellent handle. This feature is enhanced when the packaged item has an indention in the approximate center of the top of the package and at either side thereof. Preferaly the top and bottom of the package should be substantially flat.

The above-described package is self-sustaining. However, it can include a number of subsidiary features which are convenient or necessary in adapting the package to certan automated stacking, palleting or other processing and shipping procedures.

For example, the packaged items, advantageously sit on a bottom plate such as a light sheet of paperboard to facilitate relative movement of the packages during handling. Similarly the articles may rest on a tray-shaped article formed of a water impermeable substance. Such a feature is of particular value in handling packages in which ice cubes have been stuffed to facilitate cooling and to contain accidental leakage from an individual container.

In some embodiments of the invention, special promotional material may be inserted in the package. When transparent film is used, the material is readily visible to potential customers.

It is desirable that the package be formed of tensioned plastic sheets which generally envelope each set of four sides and generally form a perimeter about the package. A number of organic polymer films are suitable for such a purpose. These films should be extensible and while tension may be applied by heat shrinking, it is a particular advantage of the invention that it does not require an energy-consuming heat-shrinking process. Moreover, heat-shrunk films, especially if used in the outer layer, normally interfere somewhat with the favorable handling characteristics of the package and requires the use of film cut outs to facilitate use of the extension film as a handle. Among suitable extensible films are those formed of such heatsealable thermoplastic polymers as medium density polyethylene, copolymers of polyethylene and ethyl vinyl acetate—preferably copolymers containing about 80% or more ethylene units—and polyvinylchloride.

Flexible films with secant moduli in the range of 1500 to 5000 psi are suitable. Such polymers may have ultimate tensile strengths of from 800 to 2000 psi and are characterized by good elongation characteristics. Typically useful polymers will be extended by 30 to 50% during the snug wrapping of a package assembly and then by about 5 to 15% when the package is lifted. Clearly, the convenient implementation of the handle-formation aspect of the preferred package depends upon the mass being lifted being sufficient to extend the polymer somewhat but insufficient to cause elongation of the polymer; to the break point. Suitable polymers may be purchased from St. Regis, Union Camp, Reynolds Aluminum and other polymer film suppliers. Ethylene-vinyl acetate copolymer films with, say, a nominal 5–15% vinyl acetate content are particularly useful in making transparent packages.

Those skilled in the art will realize that different tensile/elongation i.e. stretch, characteristics will be selected for carrying different weight packages.

The film, by which the package is to be grasped is the more critical film with respect to strength. The other film will primarily be used as a retaining member. A paper, could serve as a retainer film at the cost of some of the advantages of the package. Moreover, a relatively light gauge film—say a 0.8 mil film-could be used as the retaining film in packages in which say, 1.2 mil films are used as the handle-forming film.

Another useful variation of the package is that wherein a narrower film is wrapped about the assembly before the wider film. (This will yield a package as shown in FIG. 1 modified only in that the narrower film is under, rather than on top, of the thick film. The advantage of this arrangement is that it makes the package difficult to pick up from the top but easy to pick up by the side. Therefore, when the consumer picks the package up using the narrow film strap exposed at the side, he will avoid the possibility of a package breaking because of abrasion of the bottom film which could have taken place during any relative motion on processing equipment in packaging operations.

ILLUSTRATIVE EXAMPLES OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

BRIEF DESCRIPTION OF THE DRAWINGS

Referring to FIG. 1, there is seen a package 10 formed of two congruently and vertically-stacked groups of cans 12. The total number of cans is 24, the quantity equal to a case of, say, beer. Other package 10 is wrapped, under tension a transparent, sheet 14 of 2-mil thick ethylenevinyl acetate film. The film is heat-sealed, typically, along lines 14s, one of which will be on each side of the package. Wrapped over sheet 14 is a similar sheet 16 sheet 16 is also heatsealed along two welds 16s. Sheet 16 is similar to sheet 14 except that it is somewhat narrower. It is also wrapped under tension. A tray 18 is placed beneath the cans during the packaging operation. It serves to facilitate the handling characteristics of the package on automatic equipment and also to minimize excessive localized stresses on the package when it is used.

It will be noticed that cans 12 allow the tension-wrapped film to nip in slightly at 20, i.e. at the upper midpoint of the package. This feature facilitates the picking up of the package by a handle means 22 formed of the narrow exterior film as seen in FIG. 3. The extensibility of the film, together with the force exerted by weight of the cans, results in a strong secure package which is extremely convenient to carry. FIG. 3 also demonstrates another feature of the invention. It is easy to push ice 24 through the corner openings 25 into the package and this is of value in pre-cooling the package. It is sometimes of value to replace board 18 with a tray 26 as shown in FIG. 2. The tray can be used at top or bottom of a package. It may be used to catch water or merely for aesthetic purposes.

FIG. 4 shows a cut-out portion 28 of the exterior film. These facilitate picking up the package when the exterior film is larger than is convenient to grasp. However, they also serve the purely educational function of indicating to a new user how the package is to be handled.

FIG. 5 shows an important alternate embodiment of the invention wherein the wider film is the exterior interior film 50 and the narrower film is an interior film 60. As discussed above, this embodiment is of value in that the interior film will be used as the handle means and will be grasped from the side, not the top, of the package.

Figure 1:
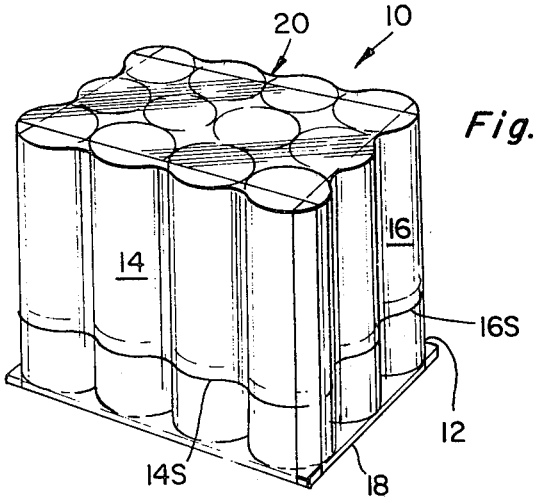
FIG. 1 is a perspective view of a package formed according to the invention.
Figure 2:
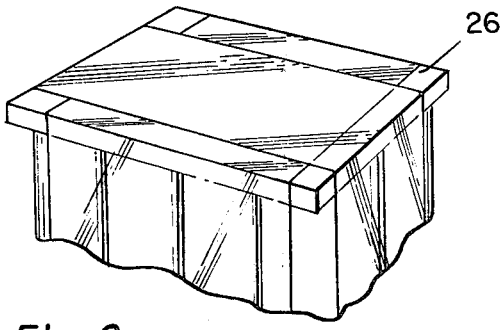
FIG. 2 is a view of a terminal portion of a package as described in FIG. 1 using a tray-type end cap.
Figure 3:
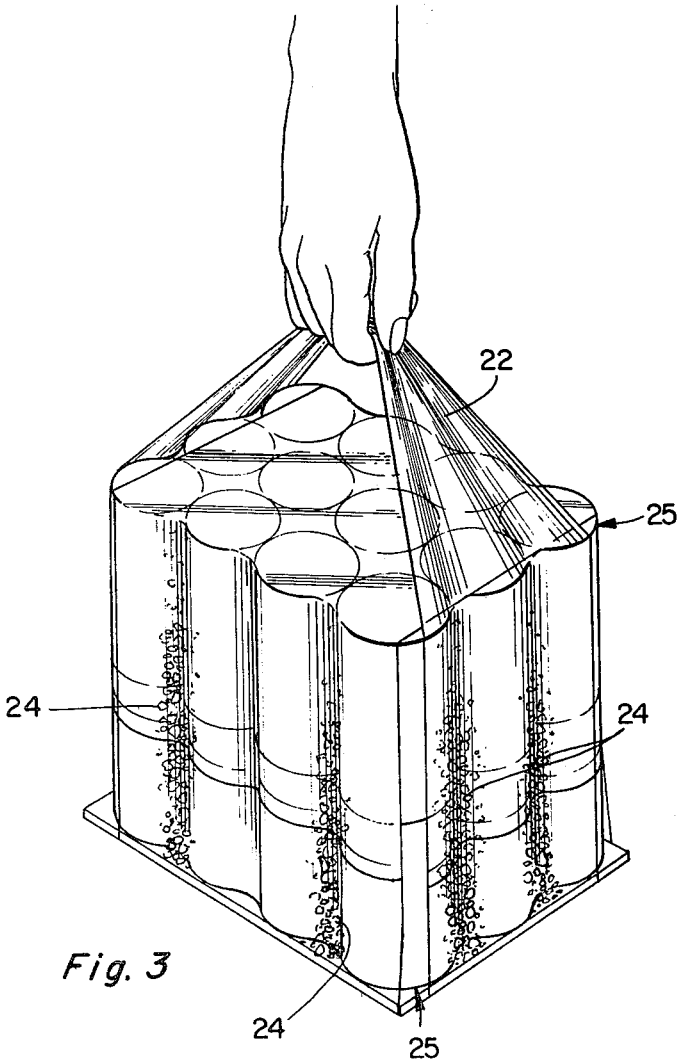
FIG. 3 is a perspective view of an embodiment of the invention showing the handle means in use.
Figure 4:
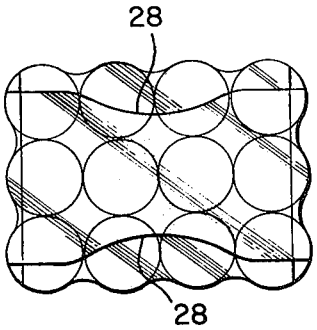
FIG. 4 is a view from the top of a package of the invention.
Figure 5:
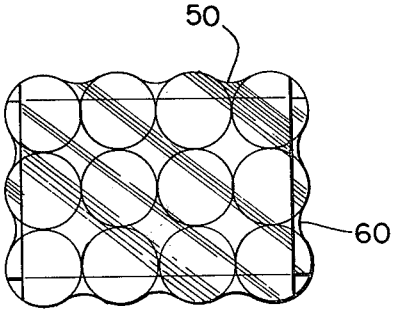
FIG. 5 is another view from the top illustrating an embodiment of the invention which is readily picked up using the interior package web.

It is also to be understood that the following claims are intended to cover all of the generic and specific features of the invention herein described and all statements of the scope of the invention which might be said to fall therebetween.

What is claimed is:

1. A package comprising
(a) an assembly of container articles to be packaged
(b) a first retaining web positioned around a set of four sides of said assembly of said articles
(c) a second retaining web positioned snugly around a different set of four sides which include the top and bottom of said assembly, and wherein said retaining webs are an stretch polymer film which forms a handle means to lift said assembly of containers when subjected to the weight of said articles.

2. A package as defined in claim 1 wherein both said retaining webs are wrapped snugly around the top and bottom of said assembly, but each in a direction normal to the direction of the other said web.

3. A package as defined in claim 2 wherein said retaining webs are each formed of stretch thermoplastic film and wherein a first web is narrower than a second web.

4. A package as defined in claim 2 wherein said retaining webs are each formed of an stretch thermoplastic film and wherein the second web is narrower than the first web.

5. A package as defined in claims 1, 2, 3 or 4 wherein said assembly of articles comprises an even number of cans along the length thereof, forming means to provide a centrally-located portion of a relatively-wide said innermost web under reduced tension; and wherein said assembly comprises a lesser number of cans across the width thereof forming means to accommodate a relatively narrow web as handle means.

6. A package as defined in claim 3 wherein said retaining webs are formed of an extensible thermoplastic film.

7. A package as defined in claim 1, 2, 3 or 4 wherein said package comprises at least two congruently and vertically-stacked rectangular assemblies of cans; each said rectangular assembly being at least three cans wide and four cans long.

8. A package as defined in claims 1, 2, 3 or 4 wherein said package comprises a base plate.

9. A package as defined in claim 1, 2, 3 or 4 wherein said package comprises a water-retentive, tray-shaped base plate.

10. A package as defined in claims 1, 2, 3 or 4 wherein said webs are spaced and sized to form means to accept and retain ice cubes in said package.

11. A package as defined in claims 1, 2, 3 or 4 wherein one web is wider than the other web and substantially covers the tops of the top row of containers within said package and wherein the other web forms said handle means.

12. A process of packaging an assembly of cans comprising the steps of (1) forming said assembly of cans so that an indentation is formed proximate the center thereof (2) placing a first extensible film web snugly about said assembly in such a way as to cover most of the top of said assembly (3) forming a handle means by placing a relatively narrow second stretch film web snugly around said assembly in a direction such that it is wrapped normal to the first web as it encircles the top and bottom of said assembly.

13. A process as defined in claim 11 wherein the relative width of said webs are chosen to provide means to insert ice into the corners of said packaged assembly.

* * * * *

UNITED STATES PATENT AND TRADEMARK OFFICE

CERTIFICATE OF CORRECTION

PATENT NO. : 4,304,332

DATED : December 8, 1981

INVENTOR(S) : Bernard R. Danti

It is certified that error appears in the above-identified patent and that said Letters Patent are hereby corrected as shown below:

Column 1, line 9: change "sucb" to -- such --.

Column 1, line 64: change "preferaly" to -- preferably --.

Column 2, line 18: change "envelope" to -- envelop --.

Column 2, line 47: delete the ";" after "polymer".

Column 2, line 68: insert -- ) -- after "film."

Column 3, line 41: change "Other" to -- Over --.

Column 3, line 46: change "sheet 16 sheet" to --sheet 16.Sheet-

Column 4, line 27: change "an" to -- a --.

Column 4, line 39: change "an" to -- a --.

Column 4, line 53: change "claim" to -- claims --.

Column 4, line 60: change "claim" to -- claims --.

Signed and Sealed this

*Thirty-first* Day of *August 1982*

[SEAL]

*Attest:*

GERALD J. MOSSINGHOFF

*Attesting Officer*

*Commissioner of Patents and Trademarks*